US005482605A

United States Patent [19]

Taylor

[11] Patent Number: 5,482,605

[45] Date of Patent: Jan. 9, 1996

[54] PORTABLE ENVIRONMENTAL CLEAN PLATING SYSTEM

[76] Inventor: James C. Taylor, 4005 Brookhaven Club Dr. #195, Dallas, Tex. 75244

[21] Appl. No.: 389,280

[22] Filed: Feb. 9, 1995

[51] Int. Cl.[6] ..... C25D 17/06; C25D 17/14

[52] U.S. Cl. ..... 204/224 R; 204/228; 204/271; 204/287

[58] Field of Search ..... 204/224 R, 271, 204/287, 228; 205/117

[56] References Cited

U.S. PATENT DOCUMENTS

| | | | |
|---|---|---|---|
| 3,520,792 | 7/1970 | Kerschgens | 204/271 X |
| 3,752,752 | 8/1973 | Slatin et al. | 204/271 UX |
| 4,067,781 | 1/1978 | Rapids | 204/224 R X |
| 4,668,364 | 5/1987 | Farmier et al. | 204/271 X |
| 5,346,602 | 9/1994 | McLaughlin | 204/271 X |
| 5,391,279 | 2/1995 | McLaughlin | 204/271 X |

*Primary Examiner*—Donald R. Valentine
*Attorney, Agent, or Firm*—John E. Vandigriff

[57] ABSTRACT

The invention relates to a portable plating system that operates stand-alone with a battery power source, or with an A.C. power source. The system is also capable of working from an automobile battery as the power source. The system is packaged in a combination storage/work station unit which stores the plating equipment when not in use, and serves as a work station when the equipment is assembled and ready for use.

18 Claims, 9 Drawing Sheets

PORTABLE ENVIRONMENTAL CLEAN PLATING SYSTEM

FIELD OF THE INVENTION

This invention relates to plating systems, and more particularly to a portable plating system that includes environmental protective considerations and apparatus and provides variable placement of the components of the system for use by handicap persons.

BACKGROUND OF THE INVENTION

Various portable plating systems exist that are basically a hand case similar to an attach case or tool case. The case has several compartments into which various attachments and tools are stored that are used in a plating process, such% as brushes, interconnection wires, power source and chemicals. Such an apparatus is described in U.S. Pat. 3,752,752.

Electroplating with such devices is used to plate small articles to provide a decorative and/or corrosion resistant coating. A D.C. power source is used with one another of the power supply connected to the article to be plated. A plating liquid containing a compound of the metal to be plated is placed on the article and brushed with another anode to transfer the plating metal from the plating liquid to the article to be plated. The plating power unit is connected to an A.C. electrical outlet.

The plating solutions contain acids and other chemicals that need to be disposed properly to protect the environment. Prior art plating systems, for the most part, do not have arrangements or protective apparatus to properly contain and collect the plating chemicals.

Other prior art systems are described in U.S. Pat. No. 2,046,440 and 4,668,3674. These systems are portable only in the sense that The equipment may be carried, but are not self contained with respect to a power source since each has to be connected to an A.C. electrical outlet.

SUMMARY OF THE INVENTION

The invention relates to a portable plating system that operates stand-alone with a 12 volt rechargeable battery power source, or with an A.C. power source. The system is also capable of working from an automobile battery as the power source, for example from a lighter adapter. The system is packaged in a combination storage/work station unit which stores the plating equipment when not in use, and serves as a work station when the equipment is assembled and ready for use. The case includes dolly wheels, a tool bar support, encloses the power supply, provides storage for the various parts of the plating system, and serves as a seat for the work station. The case is mounted on dolly wheels, has a removable handle and tool bar receivers. The tool bar receivers provide mounting support for two vertical tool bars, one for the chemical containers, plating brushes and the control box, and the other is for mounting a removable work station which may include a waste chemical accumulator. Both the tool bars and work surface are reversible, right to left.

The plating fluid accumulator is attached to the handle for storage and when moving the system and is detached and placed under the article to be plated to catch excess plating fluid to prevent the plating fluids from polluting the environment. The fluid accumulator is suitable to store the used plating fluids until they can be properly disposed of and environmentally processed.

The system is designed to plate over existing precious or semiprecious metals, including, but not limited to, automobile parts, jewelry, antiques and various other items.

The complete system is configured to enable an operator regardless of his physical dexterity or limitations to use the system, taking into consideration the safety of the operator and the protection of the environment. The system may plate new components or plate over existing metals. The system can be used as a free standing unit in the field or a work station in a shop.

The technical advance represented by the invention, as well as the objects thereof, will become apparent from the following description of a preferred embodiment of the invention when considered in conjunction with the accompanying drawings, and the novel features set forth in the appended claims.

DESCRIPTION OF A PREFERRED EMBODIMENT

Figure 1:
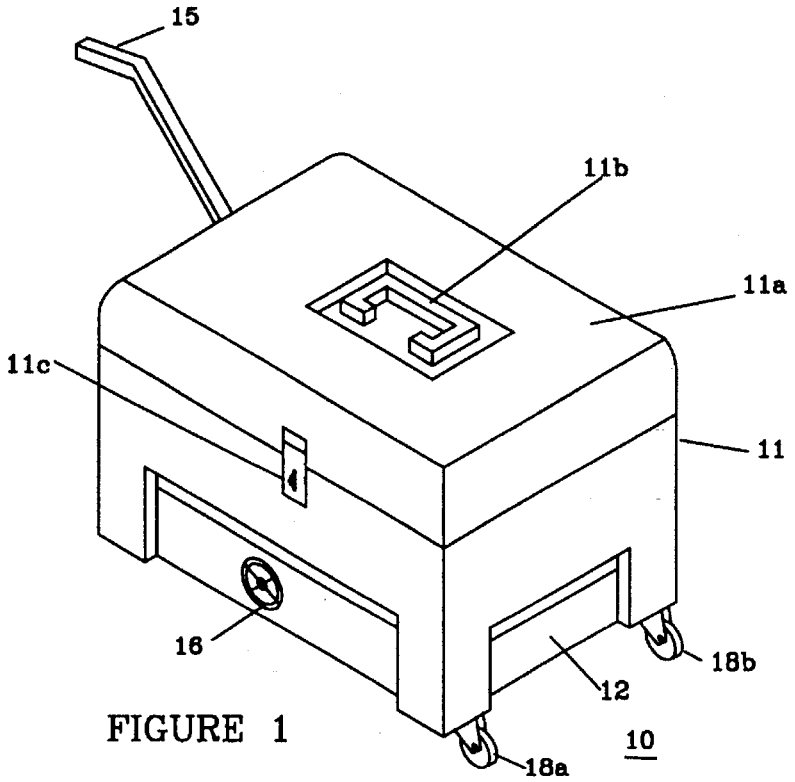
FIG. 1 shows the plating system of the present invention with the plating apparatus stored.
Figure 2:
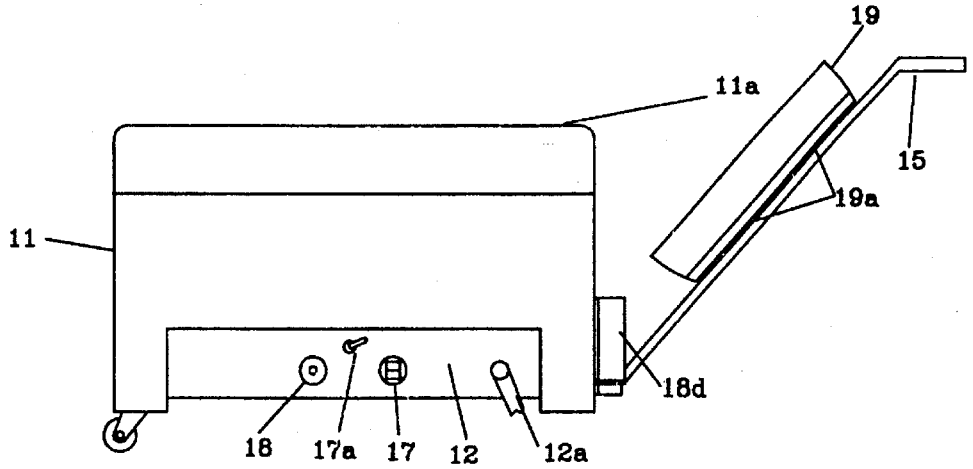
FIG. 2 shows the back of the stored plating system, showing the power cord to the power supply and power outlet and switches.

FIGS. 1 and 2 show the portable plating system 10 which is housed in a storage unit 11 having a hinged lid 11*a*, including a handle 11*b* and locking latch 11*c*. Housing 11 includes a power unit 12 which includes an A.C. power unit 13 (FIG. 3) and at least one battery 14 (FIG. 3) used for providing power to the plate system when A.C. power is not available. Power unit 12 includes a fan 16 to provide a cooling air flow for the power unit, an ON-OFF switch 17, a D.C. power outlet 18, power cord 12*a*, and a switch 17*a* to switch between the battery provided D.C. voltage and the A.C. power supply D.C.

In FIG. 1 dolly wheels 18*a* and 18*b* are shown. Wheels 18*a* and 18*b*, along with handle 15 are used in transporting the plating system. The two rollers 18*a* and 18*b* are attached on one end, and a handle 15 is attached to the other end. Tool bar receivers 18*c* (FIG. 5) and 18d are positioned on each side of the handle end for mounting rotatable and interchangeable work stations.

Figure 3:
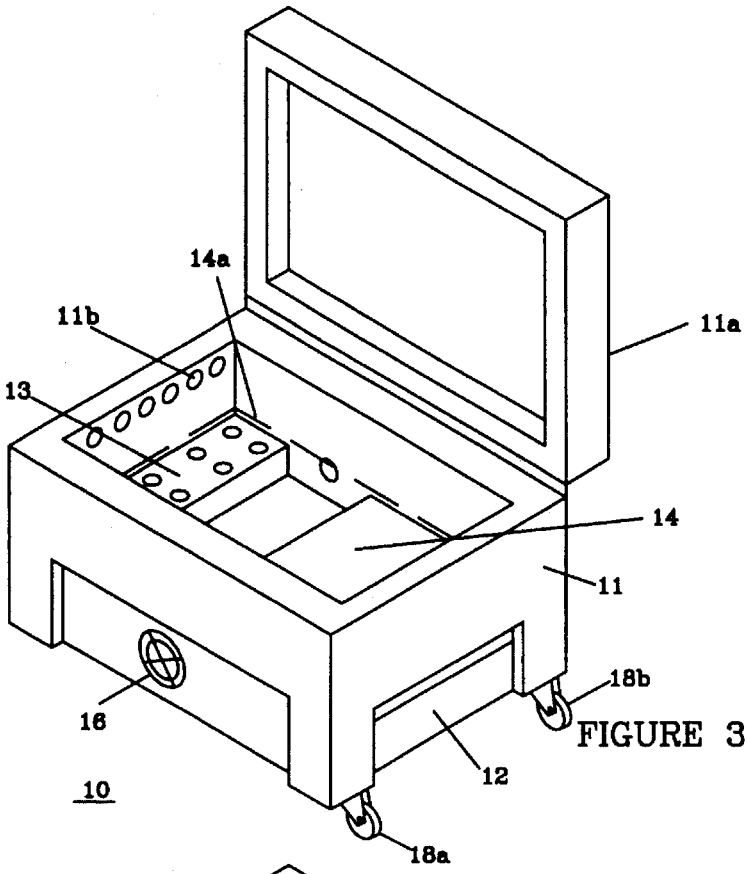
FIG. 3 shows the storage unit open showing the power supply and battery used in plating.
Figure 4:
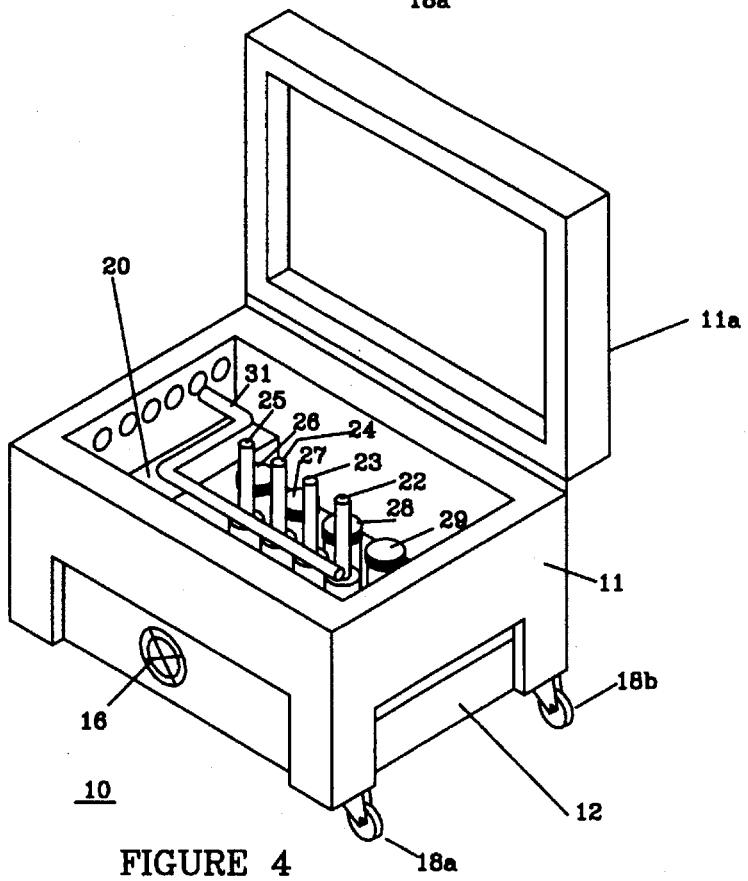
FIG. 4 shows the storage unit open showing the plating apparatus stored inside.

FIG. 3 shows housing 11 with lid 11*a* open showing the A.C. power supply 13 and battery 14. A flat plate 14*a*, shown in dashed lines, can be placed over the power supply 13 and battery 14 to provide a platform for storage of the plating supplies and apparatus as shown in FIG. 4. Ventilation holes 11*b* are in one end of housing 11 to provide air flow, generated by fan 16, over and through power supply 13.

FIG. 4 shows housing 11 with lid 11*a* open showing the plating apparatus stored. Inside housing 11 is the mounting bar 31, control unit 20, brushes 22–25 and plating solutions 26–29. Other equipment such as electrical wires and tools used in plating, safety data information and operator instructions (not illustrated) may also be stored in housing 11.

Figure 5:
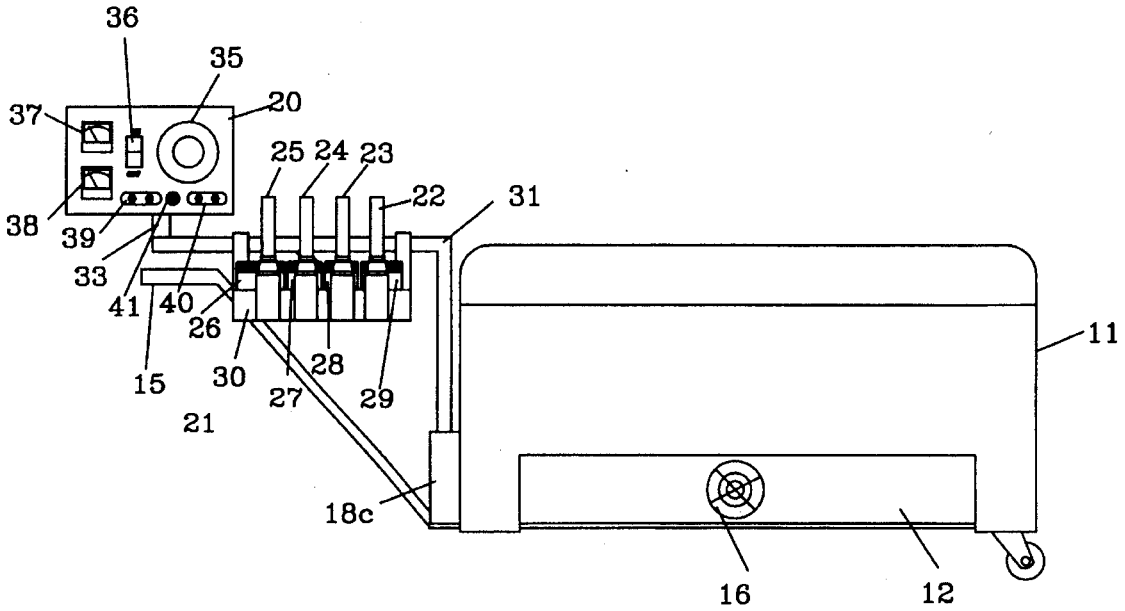
FIG. 5 is a front view of the plating system with the control unit and plating brushes and solution mounted, ready for use.

FIG. 5 shows the plating system with tool bar 31 mounted in holder 18*c*. Tool bar 31 supports control box 20 on end 33. Control box 20 includes an adjustable rotary control knob 35, reversing switch 36, voltmeter 37, amp meter 38, voltage in terminals 40, and voltage out terminals 39. The circuit of control box 20 is described below with reference to FIG. 11.

Also mounted on tool bar 31 is carrier 30 which holds plating brushes 22, 23, 24 and 25, and plating solution containers 26, 27, 8 and 29. Plating brushes or electrodes 22–25 have color coded insulated handles and are arranged directly in front of color coded chemical beakers 26–29 that contain the chemicals utilized in plating or stripping. Each beaker is color coded, black or red, to indicate either a positive or negative to indicate the polarity used with the process performed with that electrode and chemical. Black is used for negative and red for positive. This eliminates the cross contamination of chemicals and electrodes. Labels, not illustrated, may be placed in front of each electrode indicating its use.

Figure 6:
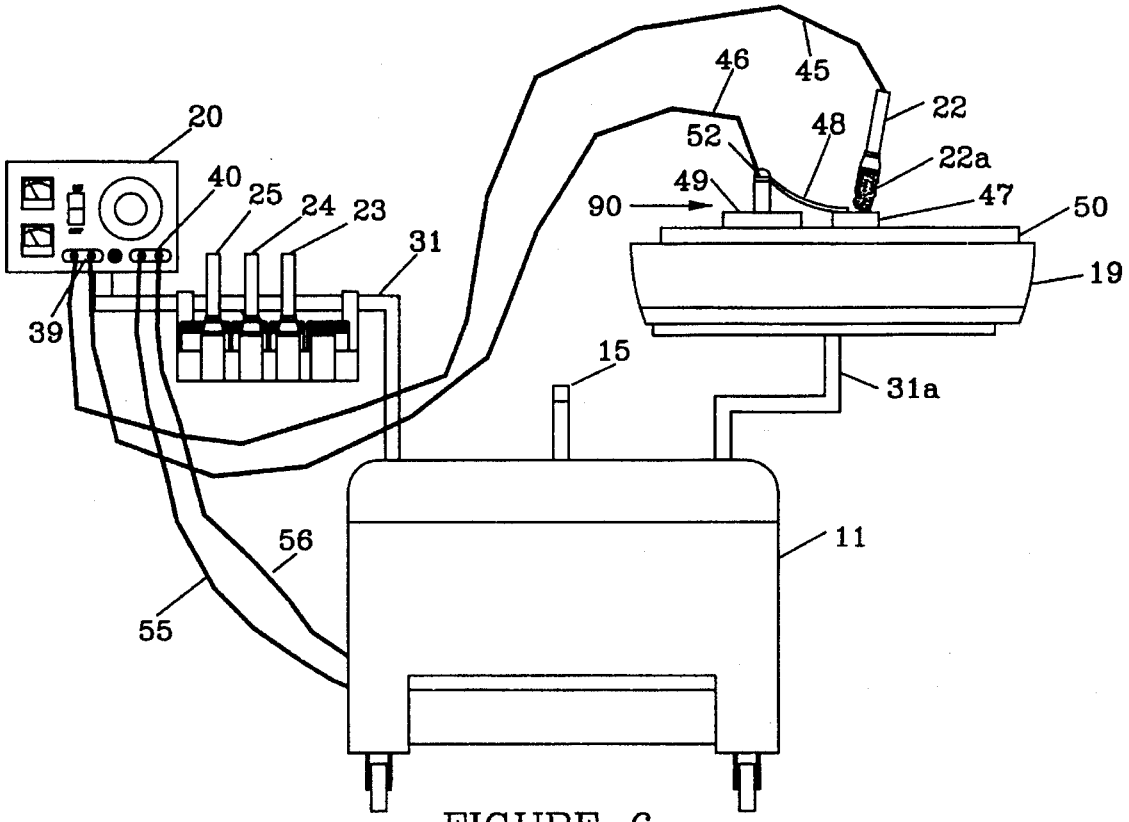
FIG. 6 is an end view of the assembled plating system.

FIG. 6 shows the portable plating system setup with the various parts of the system mounted and connected for plating. Housing 11 may be used as a seat when a part is being plated. Portable plating systems are often used for plating small decorative parts on automobiles. Since it is often not practical to remove the object to be plated, the plating is accomplished with the object mounted on the automobile. In the alterative, the portable plating system can be moved from one job location to another to plate small parts. A second tool bar 31*a* is mounted on tool bar receiver 18*d* and holds a fluid accumulator 19. A small part 47 is being plated. Part 47 is placed on a metal grid 50 with grid 50 placed above fluid accumulator 19. Part 47 is held in place by clamp 48 mounted on magnet base 49. Magnet base 49 is held against metal grid 50 by magnetic attraction, and in turn, clamp 48 holds part 47 in place against metal grid 50. Ground wire 46 is connected from the negative terminal of output terminal 39 to terminal post 52 which is in electrical contact with clamp 48. The electrical path provided by wire 46, terminal 52 and clamp 48 provides the ground of negative connection from the power supply to part 47. Power input to control box 20 is through wire 55 and 56 connected between power unit 12 and input terminals 40.

Plating brush 22 is connected to the positive terminal of output terminal 39. Plating brush 22 has an electrode that is wrapped with a soft material 22*a*, such as cotton, which has been wetted with a plating solution from one of the solution bottles 26–29. As brush 22 is moved over the surface of part 47, the electrical current from positive terminal 39 passes through wire 45, the electrode in brush 22, the conductive plating solution in material 22*a* and through part 47, through clamp 48, terminal 52, and wire 46 back to the negative terminal on output terminal 39. In the plating process, the metallic content of the plating solution is transferred in the plating process from the solution to the surface of part 47. Excess plating fluid drains into fluid accumulator 19, preventing the environmental pollution of the area around where the plating process is accomplished.

When plating a part mounted on an automobile, fluid accumulator 19 is placed under the part being plated, adjacent to the automobile.

FIG. 6 is an end view of the assembled plating system showing the control box 20, the plating chemicals and brushes mounted on tool bar 31 to the left. Part 47 is mounted on the gird 50, and held in place, for example, by a magnetic clamp. Grid 50 is on fluid accumulator 19 shown mounted on tool bar 31*a*. Accumulator may also be placed on the floor or ground when plating outside. Tool bars 31 and 31*a* may be interchanged to place the brushes and control box on the right side.

Figure 7:
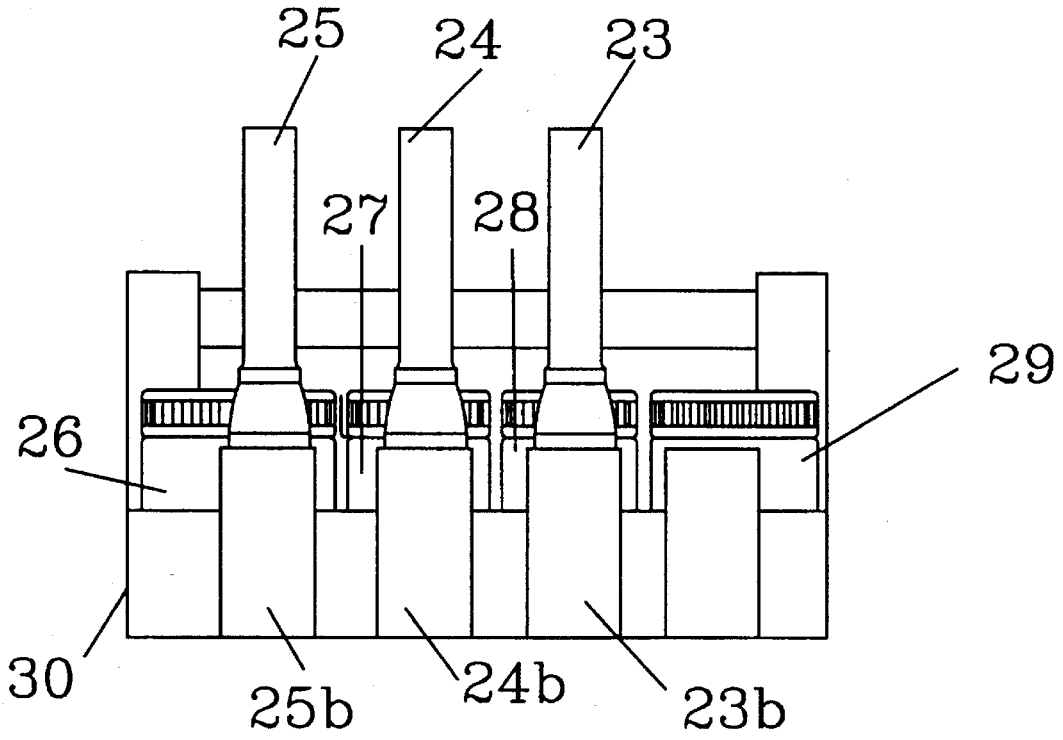
FIG. 7 is a front view of the plating solution beakers and brush holders.
Figure 8:
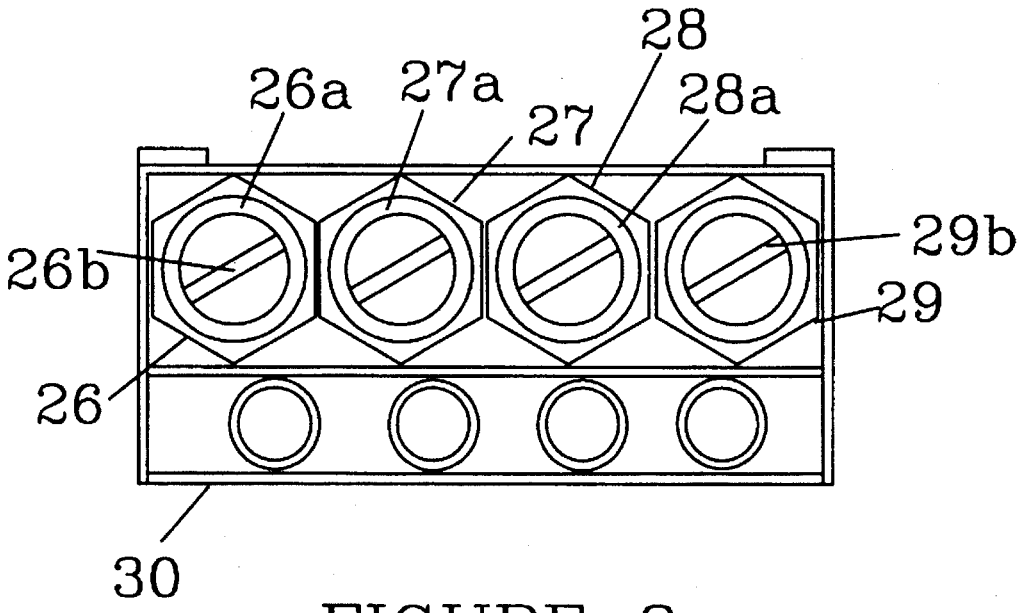
FIG. 8 is a top view of the plating solution beakers and brush holders.

FIGS. 7 and 8 show top and front views of carrier 30 and the plating solution bottles 26–29 and brushes 23–25. Plating solution bottles 26–29 have a polygonal shape to place a flat side of one bottle against a flat side of the adjacent bottle. In FIG. 8 the bottles are shown to be hexagonal. By providing flat sides on the bottles, the bottles may be opened with one hand. When removing, for example, lid 26*a* by turning lid handle 26*b*, bottle 26 will not rotate. This provides a way for a handicapped person to remove a bottle lid with only one hand.

Figure 9A:
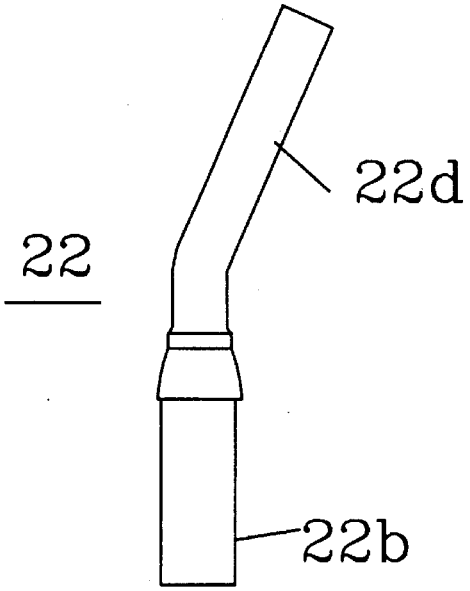
FIG. 9*a* shows a brush in a brush holder.
Figure 9B:
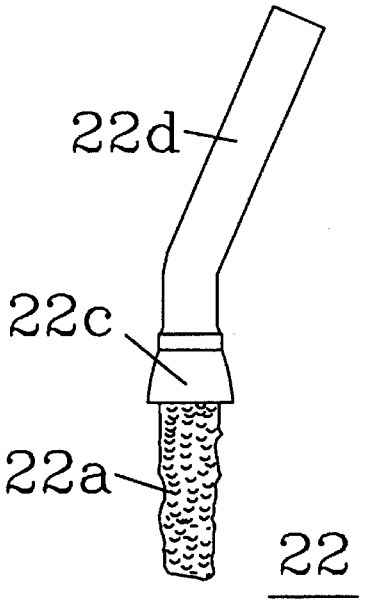
FIG. 9*b* shows a plating brush out of its holder.

FIG. 9*a* shows a plating brush 22 in one of the brush holders 22*b*. Brush holder 22*b* holds brush end 22*a* and prevents plating solution from dripping from the carrier 30. In FIG. 9*b*, brush 22 has been removed from holder 22*b*. Between plating brush end 22*a* and brush handle 22*d* is a flared seal 22*c* which resides over the open end of holder 22*b* when brush 22 is in holder 22*b*, and also prevents plating solution from running over handle 22*d* and the hand holding the brush when the brush end 22*a* is at a position higher than the handle 22*d*. The angled handle 22*d* eliminates the need to invert the electrode when working on a vertical surface.

Figure 10:
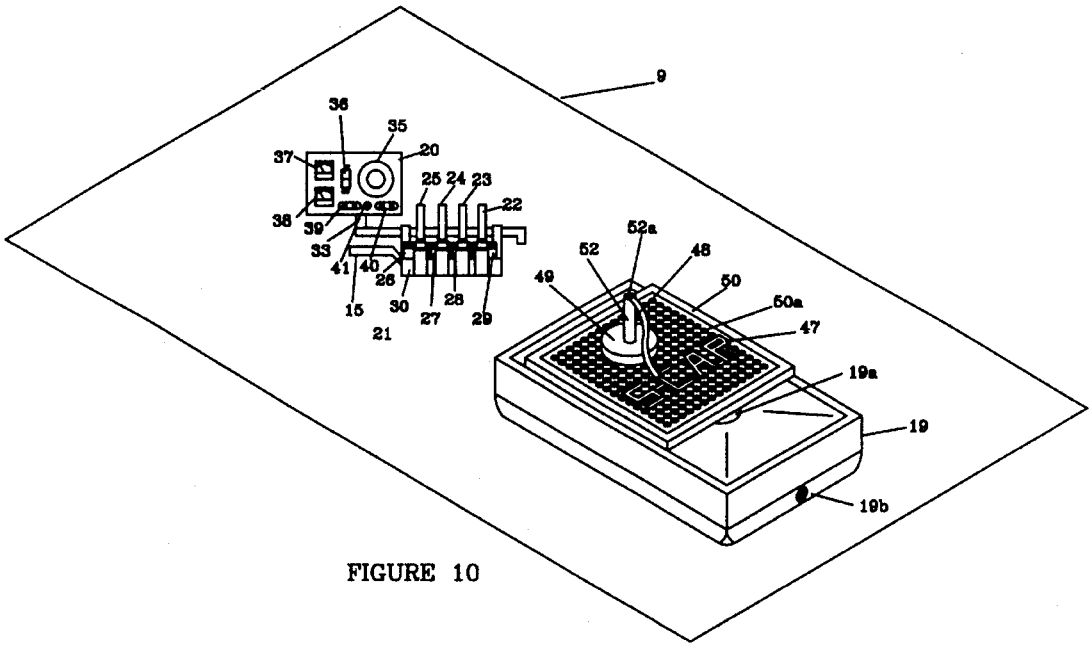
FIG. 10 shows the control unit, chemical beakers, plating brushes and the plating fluid accumulator with a plating grid thereon, all on a work surface.

FIG. 10 shows fluid accumulator 19 along with chemical and brush holder 30, and control box 20 on a work surface 9. Removable metal grid 50, having a plurality of holes 50*a* extending through grid 50, is on top of accumulator 19. Part 47 is held in place with the clamp work holder consisting of magnet base 49, terminal 52 and clamp 48. Terminal 52 is connected to the control box 20 by plugging a lighter adaptor connector into lighter receptacle 52*a* in the top of terminal 52. As plating is accomplished, excess fluid will pass through holes 50*a* and drain into the inside of a accumulator 19 through opening 19*a*. When accumulator is to be emptied, it is drained through outlet 19*b*. The connecting electrical wires 45, 46, 55 and 56 (FIG. 6) are not shown in FIG. 10 for clarity.

Figure 11:
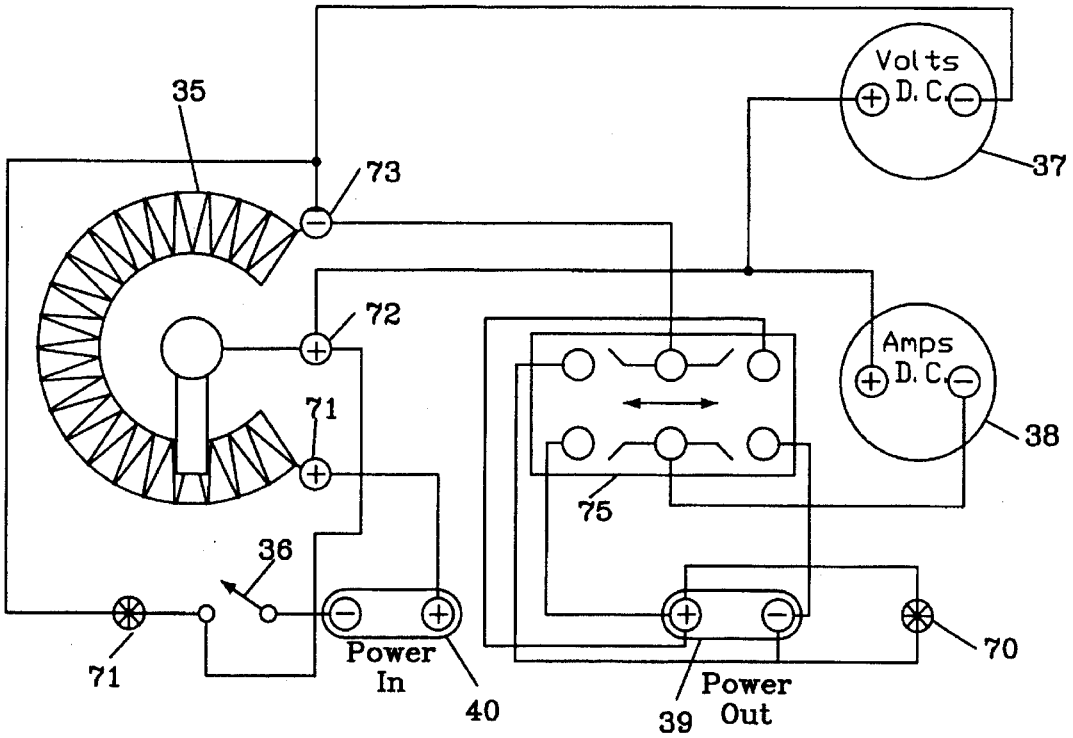
FIG. 11 shows the plating control circuit.

FIG. 11 illustrates the circuit of control box 20. D.C. voltage is input to the control box through terminal 40. The voltage input is applied across terminals 71 and 73 of rheostat 35. Rheostat 35 is adjustable so that the plating voltage can be set to the desired level. In this respect, the operator set the voltage and current to the proper levels, as indicted on meters 37 and 38, for plating, or removal of metal (in a stripping operation). Terminal 72 is connected through amp meter 38 to switch 75 which determines the polarity of the voltage to power out terminal 39. When switch 75 is moved to the left, as illustrated in FIG. 6, the out polarity will be shown as indicated at terminal 39, the left terminal is positive and the right terminal is negative. By moving switch 75 to the right, the polarity of the output terminal 39 will be reversed. Platint is accomplished with one polarity and stripping or removing the surface metal from an object is accomplished with another polarity. Lamp 70 indicates when an output voltage is applied to terminal 39. Switch 36, when closed, applies voltage across rheostat 35. Lamp 71 indicates when voltage is applied to rheostat 35. Voltmeter 37 is connected to terminals 72 and 73, and indicates the plating voltage applied to terminal 39.

Figure 12:
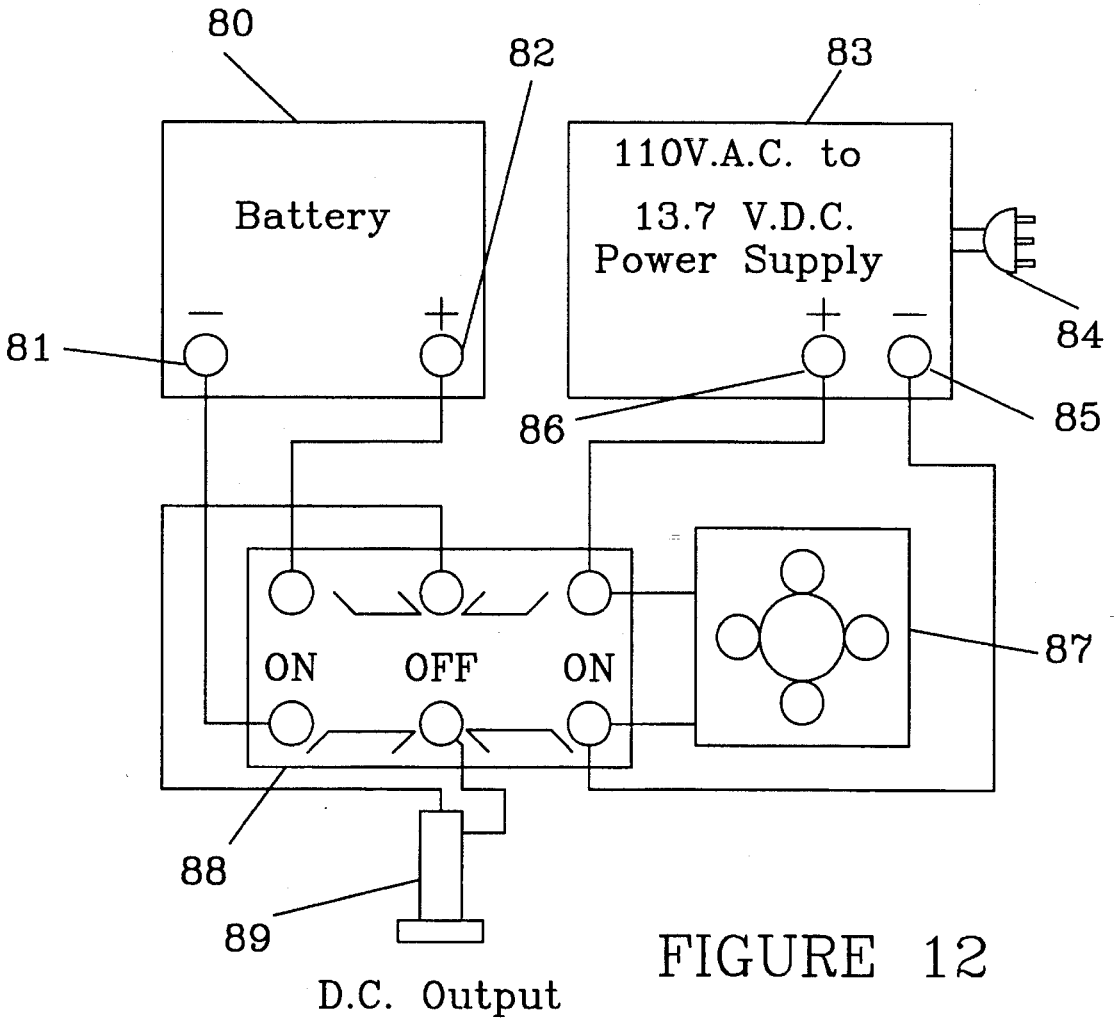
FIG. 12 shows the power supply circuit for the plating system.

FIG. 12 illustrates the combination power supply. When A.C. voltage is available, power plug 84 is connected to the A.C. supply and power supply 83 provides an output voltage of approximately 13.7 Volts D.C. When the A.C. voltage is not available, plating is accomplished by battery 80. Switch 88 switches the out 89 between the Battery supply and the A.C./D.C. power supply. When the A.C./D.C. power supply is used, cooling is supplied by fan 87. A.C./D.C. power supply is used to charge battery as necessary.

The portable plating system described above is versatile in that it may be A.C. powered , or D.C. powered with a battery. The fluid accumulator protects the environment, and can be used with small parts, or placed adjacent to other parts, attached to, for example, an automobile, to catch used or dripping plating fluid. The system provides storage for all of the plating apparatus and is easily movable utilizing the wheels and handle attached to the apparatus housing.

The plating system accommodates an operator that may be limited to the use of only one hand, either right or left. The system is totally portable, and includes the following features: fused AC/DC converter; a power supply control unit, tool bars that allow adjustment for convenient reach and control plating parameters; a magnetic clamp to hold the work piece in place; angled insulated electrode handle; sealed electrode storage for contaminated electrodes; an environmental waste containment; reversible hardware positioning for right or left handed use; and dolly wheels and handle for ease of transporting the plating system.

What is claimed is:

1. A portable plating apparatus, comprising:

a housing for storing and transporting the plating apparatus;

a combination battery/A.C. power supply;

a control box for supplying and controlling the power used in plating;

a fluid accumulator for collecting used plating fluids during plating; and a grounding plating grid over said fluid accumulator upon which small parts may be plated.

2. The plating system according to claim 1, including a mounting bar attachable to said housing for mounting said control box.

3. The plating system according to claim 1, including a plating fluid/brush rack for holding a plurality of plating fluid containers and plating brushes.

4. A portable plating apparatus according to claim 3, wherein said plating brushes have angled handles.

5. A portable plating apparatus according to claim 3, wherein said containers have flat sides so they will not turn in said rack, and said containers have lids openable by a single hand.

6. The plating system according to claim 1, wherein said housing contains a combination battery/A.C. power supply, and serves as a seat during plating.

7. The plating system according to claim 1, including a removable mounting bar on which said control box is mounted during plating, and a plating fluid/brush rack for holding a plurality of plating fluid containers and plating brushes.

8. A portable plating apparatus, comprising:

a housing for storing and transporting the plating apparatus;

a combination battery/A.C. power supply;

a mounting bar attachable to said housing for mounting said control box;

a control box, mountable upon said mounting bar, for supplying and controlling the power used in plating; and a grounding grid on which the item to be plated may be placed.

9. The plating system according to claim 8, including a grounding plating grid on said fluid accumulator upon which small parts may be plated.

10. The plating system according to claim 8, including a plating fluid/brush rack for holding a plurality of plating fluid containers and plating brushes.

11. The plating system according to claim 8, wherein said housing contains a combination battery/A.C. power supply, and serves as a seat during plating.

12. The plating system according to claim 8, including at least one removable mounting bar on which said control box is mounted during plating, and a plating fluid/brush rack for holding a plurality of plating fluid containers and plating brushes.

13. The plating system according to claim 8, including two dolly wheels under said housing, and a handle attached to said housing for moving said plating apparatus from one work place to another.

14. The plating system according to claim 8, wherein said housing includes a lid covering an interior storage area in which the plating apparatus is stored when not in use or during movement from one work place to another.

15. The plating system according to claim 14, wherein said housing lid serves as a seat for a person using the plating apparatus.

16. A portable plating apparatus according to claim 8, including mounting brackets on said housing for reversible mounting and positioning of the mounting bar and the control box to accommodate right or left handed use.

17. A portable plating apparatus, comprising:

a housing for storing and transporting the plating apparatus;

a combination battery/A.C. power supply mounted inside said housing;

a mounting bar removably attachable to said housing;

a plating fluid/brush rack for holding a plurality of plating fluid containers and plating brushes;

a control box, mountable upon said mounting bar, for receiving power from said power supply, supplying power to plating brushes, and controlling the power used in plating;

a fluid accumulator for collecting used plating fluids: and a grounding plating grid on said fluid accumulator upon which small parts may be plated.

18. A portable plating apparatus according to claim 17, including a volt meter and a current meter in said power supply for monitoring and controlling actual plating voltage and current.

* * * * *